US010626716B2

(12) United States Patent
Hay

(10) Patent No.: US 10,626,716 B2
(45) Date of Patent: Apr. 21, 2020

(54) WELLBORE TRAJECTORY VISUALIZATION AND RANGING MEASUREMENT LOCATION DETERMINATION

(71) Applicant: Halliburton Energy Services, Inc., Houston, TX (US)

(72) Inventor: Richard Thomas Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 413 days.

(21) Appl. No.: 15/523,459

(22) PCT Filed: Dec. 10, 2014

(86) PCT No.: PCT/US2014/069515
§ 371 (c)(1),
(2) Date: May 1, 2017

(87) PCT Pub. No.: WO2016/093817
PCT Pub. Date: Jun. 16, 2016

(65) Prior Publication Data

US 2017/0321535 A1 Nov. 9, 2017

(51) Int. Cl.

| | |
|---|---|
| ***G01V 1/40*** | (2006.01) |
| ***E21B 47/022*** | (2012.01) |
| ***E21B 47/04*** | (2012.01) |

(52) U.S. Cl.
CPC ..... *E21B 47/022* (2013.01); *E21B 47/04* (2013.01)

(58) Field of Classification Search
None
See application file for complete search history.

(56) References Cited

U.S. PATENT DOCUMENTS

| | | | |
|---|---|---|---|
| 4,957,172 | A | 9/1990 | Patton et al. |
| 5,901,795 | A | 5/1999 | Tsao et al. |

(Continued)

FOREIGN PATENT DOCUMENTS

| | | | |
|---|---|---|---|
| EP | 2518264 | A1 | 10/2011 |
| WO | 2013/110542 | A1 | 8/2013 |
| WO | 2014/089402 | A2 | 6/2014 |

OTHER PUBLICATIONS

"Optimize Wellbore Placement Using Real-Time 3D Visualization to Maximize Reservoir Contact," WellLink 3D Service, Baker Hughes brochure, 2011, 2 pages.

(Continued)

*Primary Examiner* — Aditya S Bhat
(74) *Attorney, Agent, or Firm* — Jason Sedano; Baker Botts L.L.P.

(57) ABSTRACT

A wellbore ranging system includes a processor, a memory, and a wellbore ranging module. The wellbore ranging module is operable to receive survey information in response to a survey measurement signal and determine a location of a first wellbore in a formation. The wellbore ranging module is further operable to receive first ranging information in response to a first ranging measurement signal and determine, based on the first ranging information, a location of a second wellbore in the formation and a second wellbore location error associated with the determined location of the second wellbore in the formation. The wellbore ranging module is also operable to determine, using the location of the first wellbore, the location of the second wellbore, and the second wellbore location error, a next location at which to send a second ranging measurement signal.

36 Claims, 3 Drawing Sheets

(56) References Cited

U.S. PATENT DOCUMENTS

| | | | | |
|---|---|---|---|---|
| 7,814,989 | B2 | 10/2010 | Nikolakis-Mouchas et al. | |
| 7,878,268 | B2 | 2/2011 | Chapman et al. | |
| 8,289,024 | B2 | 10/2012 | Clark et al. | |
| 8,462,012 | B2 | 6/2013 | Clark et al. | |
| 9,404,355 | B2 * | 8/2016 | Bayliss | E21B 44/005 |
| 2010/0241410 | A1 | 9/2010 | McElhinney et al. | |
| 2011/0079431 | A1 | 4/2011 | Clark | |
| 2011/0133741 | A1 | 6/2011 | Clark | |
| 2012/0147006 | A1 | 6/2012 | Rothnemer | |
| 2012/0194195 | A1 | 8/2012 | Wisler et al. | |
| 2013/0341092 | A1 | 12/2013 | Hay et al. | |
| 2014/0374159 | A1 * | 12/2014 | McElhinney | E21B 7/04 175/45 |

OTHER PUBLICATIONS

Santos, O. L. A., and J. J. Azar. "The Development and Field Application of a 3D Computer Graphics System for Displaying Wellbore Trajectories." SPE Eastern Regional Meeting. Society of Petroleum Engineers, 1994.

"Well Planning and Engineering," Geotarget Drilling Services, at http://www.geotarget-drilling.com/well-planning-and-engineering.php, 2011, 3 pages.

Jamieson, Angus, "Introduction to Wellbore Positioning," Research Office of UHI, 2012, 198 pages.

"Three-D Real-Time Visualization Service Facilitates Accurate, Timely Decisions," at https://rogtecmagazine.com/baker-hughes-introduces-new-version-of-welllink-3d-visualization/, Nov. 4, 2011, 4 pages.

Thorogood, J. L, and S. J. Sawaryn. The Traveling-Cylinder Diagram: A Practical Tool for Collision Avoidance. SPE Drill Eng 6 (1): 31-36. SPE-19989-PA. http://dx. doi. org/10.2118/19989-PA, 1991.

Sawaryn, Steven J., and John L Thorogood. "A compendium of directional calculations based on the minimum curvature method." SPE annual technical conference and exhibition. Society of Petroleum Engineers, 2003.

International Search Report and Written Opinion issued in related PCT Application No. PCT/US2014/069515 dated Aug. 21, 2015, 9 pages.

Wolff, Chris JM, and John P. De Wardt. "Borehole position uncertainty-analysis of measuring methods and derivation of systematic error model." Journal of Petroleum Technology 33.12 (1981): 2-338.

International Preliminary Report on Patentability issued in related Application No. PCT/US2014/069515, dated Jun. 22, 2017 (7 pages).

* cited by examiner

WELLBORE TRAJECTORY VISUALIZATION AND RANGING MEASUREMENT LOCATION DETERMINATION

CROSS-REFERENCE TO RELATED APPLICATION

The present application is a U.S. National Stage Application of International Application No. PCT/US2014/069515 filed Dec. 10, 2014, which is incorporated herein by reference in its entirety for all purposes.

BACKGROUND

The present disclosure relates generally to wellbore ranging and, more particularly, to visualizing drilling trajectories of adjacent wellbores using periodic measurements and determining locations at which to take additional periodic measurements.

Hydrocarbons, such as oil and gas, are commonly obtained from subterranean formations that may be located onshore or offshore. In some instances, operations for removing the hydrocarbons from the subterranean formations may include drilling a second wellbore in close proximity to a first wellbore. The wellbores may intersect or not intersect, depending on the application. For example, a blowout (i.e., an uncontrolled release of hydrocarbons from the wellbore) may occur in the first wellbore, which may require the drilling of a second relief wellbore that purposefully intersects with the first wellbore at some depth. As another example, Steam Assisted Gravity Drainage (SAGD) techniques may call for two wellbores to be drilled somewhat parallel to one another that do not intersect. It may therefore be desirable to obtain information about the locations of the two wellbores with respect to one another during drilling. To do so, periodic measurements may be taken while drilling.

BRIEF DESCRIPTION OF THE DRAWINGS

For a more complete understanding of the present disclosure and its features and advantages, reference is now made to the following description, taken in conjunction with the accompanying drawings, in which.

Figure 1:
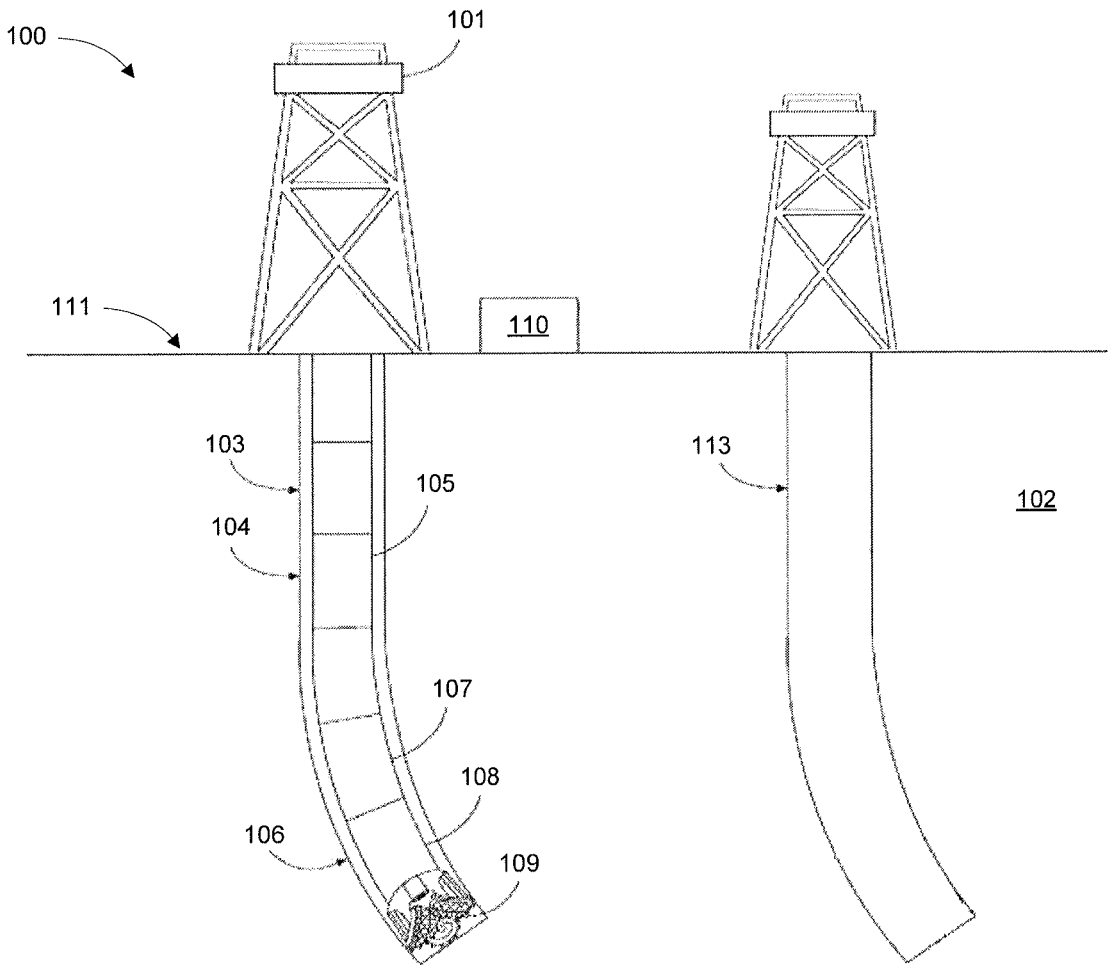
FIG. 1 illustrates an example drilling system, in accordance with embodiments of the present disclosure.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure describes systems and methods for visualizing the respective locations of adjacent wellbores in three dimensions based on measurements taken at different depths. This may be done through the use of survey and/or ranging measurements. Survey measurements may be taken uphole (e.g., at the surface of a drilling system) and may provide data that may assist in determining the position of a wellbore in three dimensions with respect to the formation. Survey measurements may come from tools such as accelerometers or gyroscopes located at various locations near a wellbore. Ranging measurements, on the other hand, may be taken from within one of the two wells and may provide data that may assist in determining the positions of the two wells with respect to one another. Ranging measurement may come from magnetic or electromagnetic measurement tools located at various locations within a wellbore.

The visualization of the respective well locations may include both past trajectory (e.g., based on past ranging measurements) as well as projected future trajectory (based on the current drilling path). In particular embodiments, the location of the second wellbore may be determined using ranging and/or survey measurements. As such, measurement error ranges (from either the ranging or survey measurements) may be determined and indicated in the visualization. In some embodiments, uncertainty values may be determined and represented in the visualization (e.g., through cones or ellipses) for each projected wellbore trajectory based on uncertainty models, such as the Wolfe Dewardt ellipse uncertainty model. Using the projected trajectory paths incorporating the determined uncertainty values, areas of potential collision between the wells may be determined and indicated in the visualization. In addition, using the projected trajectories, depths at which to take additional survey measurements may be determined and displayed in the visualization. Each of the determined and/or displayed data (e.g., the trajectories or error ranges) may be updated as additional survey and/or ranging measurements are taken.

By providing three-dimensional visualization and determinations of locations at which to take additional ranging measurements, the present disclosure is well adapted to allow an operator of drilling equipment to more easily understand the impact of the current wellbore steering relative to a second wellbore and to provide a novel approach to determining when another ranging measurement may be necessary. The present disclosure is also well adapted to allow for the merging of the uncertainty of ranging measurements with the uncertainty of survey measurements into a single visualization. As such, the present disclosure may provide a more accurate and cohesive visualization of the respective locations and trajectories of multiple adjacent wellbores.

To facilitate a better understanding of the present disclosure, the following examples of certain embodiments are given. In no way should the following examples be read to limit, or define, the scope of the disclosure. Embodiments of the present disclosure and its advantages are best understood by referring to FIGS. 1 through 4, where like numbers are used to indicate like and corresponding parts.

FIG. 1 illustrates an example drilling system 100, in accordance with embodiments of the present disclosure. The drilling system 100 includes a rig 101 located at a surface 111 and positioned above a wellbore 103 within a subterranean formation 102. In certain embodiments, a drilling assembly 104 may be coupled to the rig 101 using a drill string 105. In other embodiments, the drilling assembly 104 may be coupled to the rig 101 using a wireline or a slickline, for example. The drilling assembly 104 may include a bottom hole assembly (BHA) 106. The BHA 106 may include a drill bit 109, a steering assembly 108, and a LWD/MWD apparatus 107. A control unit 110 located at the surface 111 may include a processor and memory device (e.g., computing device 200 of FIG. 2), and may communicate with elements of the BHA 106, in the LWD/MWD apparatus 107, and the steering assembly 108. The control unit 110 may receive data from and send control signals to the BHA 106. Additionally, at least one processor and memory device may be located downhole within the BHA 106 for the same purposes. The LWD/MWD apparatus 107 may log the formation 102 both while the wellbore 103 is being drilled, and after the wellbore is drilled to provide information regarding ongoing subterranean operations. For example, LWD/MWD apparatus may log a trajectory of the wellbore 103, take periodic ranging measurements to determine a relative location of wellbore 113, or determine one or more characteristics of formation 102 (e.g., formation resistivity, hardness, and/or type) during drilling operations. The steering assembly 108 may include a mud motor that provides power to the drill bit 109, and that is rotated along with the drill bit 109 during drilling operations. The mud motor may be a positive displacement drilling motor that uses the hydraulic power of the drilling fluid to drive the drill bit 109. In accordance with an embodiment of the present disclosure, the BHA 106 may include an optionally non-rotatable portion. The optionally non-rotatable portion of the BHA 106 may include any of the components of the BHA 106 excluding the mud motor and the drill bit 109. For instance, the optionally non-rotatable portion may include a drill collar, the LWD/MWD apparatus 107, bit sub, stabilizers, jarring devices and crossovers. In certain embodiments, the steering assembly 108 may angle the drill bit 109 to drill at an angle from the wellbore 103. Maintaining the axial position of the drill bit 109 relative to the wellbore 103 may require knowledge of the rotational position of the drill bit 109 relative to the wellbore 103.

Wellbore 103 may be relatively adjacent to wellbore 113, as shown in FIG. 1. Wellbore 113 may be an existing wellbore for a hydrocarbon producing well, or may be a wellbore being drilled simultaneously with wellbore 103 with a drilling system similar to rig 101 and its components 103-109. In particular embodiments, wellbore 103 may be drilled in such a way that it intersects with wellbore 113 at a particular point. For example, wellbore 113 may be an existing well experiencing a blowout or other issue, and wellbore 103 may be drilled to be a relief well that intersects with wellbore 113. In other embodiments, wellbore 103 may be drilled such that it does not ever intersect with wellbore 113. For example, wellbores 103 and 113 may be twinned or parallel wells for use in SAGD drilling applications.

Modifications, additions, or omissions may be made to FIG. 1 without departing from the scope of the present disclosure. For example, FIG. 1 illustrates components of drilling system 100 in a particular configuration. However, any suitable configuration of drilling components for drilling a hydrocarbon well may be used. Furthermore, although not illustrated in FIG. 1, it will be understood that wellbore 113 may include one or more drilling components (e.g., for embodiments wherein wellbore 113 is drilled simultaneously with wellbore 103) or components for extracting hydrocarbons (e.g., for embodiments wherein wellbore 113 is a hydrocarbon producing well).

Figure 2:
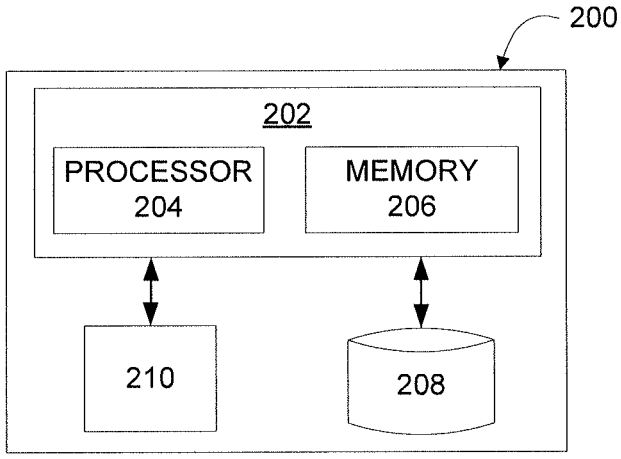
FIG. 2 illustrates a block diagram of an exemplary computing system for use in the drilling system of FIG. 1, in accordance with embodiments of the present disclosure.

FIG. 2 illustrates a block diagram of an exemplary computing system 200 for use in drilling system 100 of FIG. 1, in accordance with embodiments of the present disclosure. Computing system 200 or components thereof can be located at the surface (e.g., in control unit 110), downhole (e.g., in BHA 106 and/or in LWD/MWD apparatus 107), or some combination of both locations (e.g., certain components may be disposed at the surface while certain other components may be disposed downhole, with the surface components being communicatively coupled to the downhole components).

Computing system 200 may be configured to visualize the respective locations of a first wellbore and an adjacent second wellbore based on periodic measurements (e.g., ranging and/or survey measurements), in accordance with the teachings of the present disclosure. For example, computing system 200 may be configured to generate a visualization similar to visualization 300 of FIG. 3 in some embodiments. In addition, computing system 200 may be configured to determine a location at which to take a next periodic ranging measurement during drilling. For example, computing system 200 may be used to perform the steps of the method described below with respect to FIG. 4.

In particular embodiments, computing system 200 may include wellbore ranging module 202. Wellbore ranging module 202 may include any suitable components. For example, in some embodiments, wellbore ranging module 202 may include processor 204. Processor 204 may include, for example a microprocessor, microcontroller, digital signal processor (DSP), application specific integrated circuit (ASIC), or any other digital or analog circuitry configured to interpret and/or execute program instructions and/or process data. In some embodiments, processor 204 may be communicatively coupled to memory 206. Processor 204 may be configured to interpret and/or execute program instructions or other data retrieved and stored in memory 206. Program instructions or other data may constitute portions of software 208 for carrying out one or more methods described herein. Memory 206 may include any system, device, or apparatus configured to hold and/or house one or more memory modules; for example, memory 206 may include read-only memory, random access memory, solid state memory, or disk-based memory. Each memory module may include any system, device or apparatus configured to retain program instructions and/or data for a period of time (e.g., computer-readable non-transitory media). For example, instructions from software 208 may be retrieved and stored in memory 206 for execution by processor 204.

In particular embodiments, wellbore ranging module 202 may be communicatively coupled to one or more displays 210 such that information processed by wellbore ranging module 202 may be conveyed to operators of drilling and logging equipment. For example, wellbore ranging module 202 may convey ranging, survey, or other measurements from LWD/MWD apparatus 107 to display 210. As another example, wellbore ranging module 202 may generate one or more visualizations of the wellbores and their respective trajectories, similar to visualization 300 of FIG. 3.

Modifications, additions, or omissions may be made to FIG. 2 without departing from the scope of the present disclosure. For example, FIG. 2 shows a particular configuration of components of computing system 200. However, any suitable configurations of components may be used. For example, components of computing system 200 may be implemented either as physical or logical components. Furthermore, in some embodiments, functionality associated with components of computing system 200 may be implemented in special purpose circuits or components. In other embodiments, functionality associated with components of computing system 200 may be implemented in configurable general purpose circuit or components. For example, components of computing system 200 may be implemented by configured computer program instructions.

Figure 3:
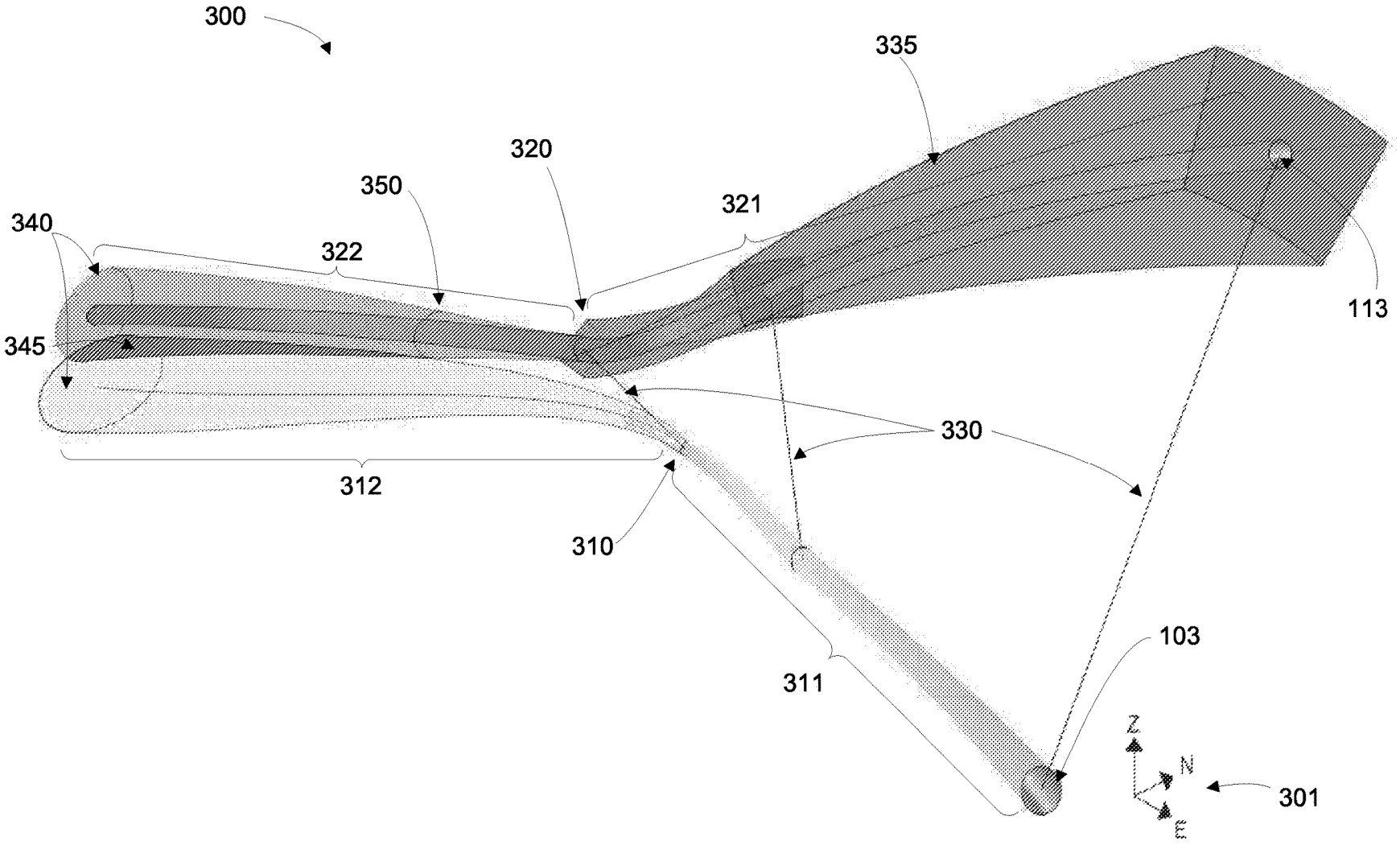
FIG. 3 illustrates an example visualization of the respective locations of the wellbores of FIG. 1 based on periodic measurements, in accordance with embodiments of the present disclosure.

FIG. 3 illustrates an example visualization 300 of the respective locations of wellbores 103 and 113 of FIG. 1 based on periodic measurements, in accordance with embodiments of the present disclosure. In particular, FIG. 3 illustrates a perspective view of wellbore 103 and wellbore 113 looking down from the surface and from an angle off to the left of the two wellbores. In certain embodiments, an operator of a drilling system may rotate, zoom, or otherwise manipulate the visualization to any desired perspective during drilling operations. In certain embodiments, an orthogonal axis indicator 301 may be provided as shown in FIG. 3 to aid an operator of the drilling system in understanding the relative orientations and positions of the two wells with respect to some reference (e.g., the surface). Visualization 300 includes the past trajectories 311 and 321 of wellbores 103 and 113, respectively, as well as the future trajectories 312 and 322 of wellbores 103 and 113, respectively. Past trajectories 311 and 321 may represent the path of the respective wellbores in formation 102 at depths above a current depth of one or both wellbores (such as current depth 310 of wellbore 103 or current depth 320 of wellbore 113), while future trajectories 312 and 322 may represent the path of the respective wellbores in formation 102 at depths below a current depth of one or both wellbores. For example, in embodiments where wellbore 103 is to be a relief well for existing wellbore 113, future trajectory 312 of wellbore 103 may represent the projected path of wellbore 103 at current steering conditions for wellbore 103, while future trajectory 322 of wellbore 113 may represent a predicted path of the existing wellbore 113 based on survey and/or ranging measurements. As another example, in embodiments where wellbore 103 and wellbore 113 are drilled simultaneously, future trajectory 312 of wellbore 103 may represent the projected path of wellbore 103 based on measurements such as survey or ranging measurements, while future trajectory 322 of wellbore 113 may represent the projected path of wellbore 113 based on current steering conditions and/or measurements such as survey or ranging measurements.

Visualization 300 includes three ranging measurements 330 taken from wellbore 310 at different depths, which may indicate an estimated distance between the first wellbore 310 and the second wellbore 320. In certain embodiments, visualization 300 may include indications of the depths at which the ranging measurements have been taken (not shown in FIG. 3). Ranging measurements 330 may each be associated with a ranging error, which may indicate a confidence level of the ranging measurements with respect to the distance and/or direction determined by the ranging measurement 330. In certain embodiments, the ranging error may be indicated in visualization 300 (shown in FIG. 3 as the shaded section surrounding past trajectory 321 of wellbore. 320, referred to herein as the ranging error window 335). Based on the ranging error, a minimum and a maximum associated with the distance of the second wellbore from the first wellbore may be determined, in particular embodiments. A range associated with the direction of the second wellbore from the first wellbore may also be determined, in certain embodiments. As shown in FIG. 3, the first arc in the ranging error window 335 indicates the determined minimum distance to the second wellbore, while the top arc of the ranging error window 335 indicates the determined maximum distance to the second wellbore. The left and right sides of the ranging error window 335 represent the determined range of directional error to the second wellbore. In particular embodiments, the ranging error window 335 may represent a plane in the formation in which the second wellbore could reside. The size of the ranging error window 335 may be determined by the accuracy of the ranging measurement, and may change with each ranging measurement taken during drilling (e.g., due to varying formation properties at the different depths).

Wellbore 103 and/or wellbore 113 may be shaded, colored, or otherwise noted in visualization 300 to indicate one or more properties of the formation, in particular embodiments. Such indications may aid an operator of the drilling system in determining potential causes for the ranging error determined. For example, first wellbore 310 may be shaded at the various depths indicated in visualization 300 to indicate a resistivity of the formation, a type of the formation, or a strength of the formation. As another example, first wellbore 310 may be colored in SAGD drilling systems to indicate particular segments at which the first wellbore 310 is in good separation distance from second wellbore 320 and/or segments at which the first wellbore 310 is too close to second wellbore 320, which may aid the drilling operator in properly steering the wellbore for SAGD recovery operations and avoiding unwanted intersections.

In embodiments where ranging error window 335 is indicated in visualization 300, the error window values for intermediate depths may be determined using interpolation techniques. It will be understood that any suitable interpolation technique may be used to determine and visualize the ranging error window 335 in visualization 300. For instance, a minimum curvature method may be used along with a linear scaling method to adjust for the error window size relative to the size of wellbore 113. Three-dimensional perspective may then be added to the visualization to make objects farther away appear smaller and those closer appear bigger.

Visualization 300 may also include a representation of error for future trajectories 312 and 322, in particular embodiments. For instance, error models based on the cumulative effect of survey measurements (e.g., the Wolfe-Dewardt ellipse of uncertainty model) may be used to determine a range of error in the future trajectories 312 and 322. This range of error may be illustrated in visualization with a conical or elliptical shading, as shown in FIG. 3 as the conical shading surrounding future trajectories 312 and 322 (referred to herein as the survey error window 340). In certain embodiments, the survey error window 340 may begin with an error of zero at current depths 310 and 320 and expand as the depth increases as shown in FIG. 3, or may begin at the value of the ranging error determined at current depths 310 and 320 and expand from that value as the depth increases (i.e., the survey error window 340 would begin at the end of the ranging error window 335). In certain embodiments, the determined ranging error and survey error may be merged at and near the point of transition (i.e., at depth 320) between the two models, such that the maximum error determined for each in any direction is used to represent the area of uncertainty (i.e., the survey error window 340) from the transition point forward. For example, the shape of the survey error window 340 may transition from a ring segment shape (as shown in visualization 300 as ranging error window 335) to an elliptical shape (as shown in visualization 300 as survey error window 340) over a depth interval as the ellipse error grows in size relative to the ranging error as depth increases beyond the transition point between the ranging error and survey error. In particular embodiments, visualization 300 may further include a representation of where the survey error windows 340 for wellbore 103 and 113 overlap (referred to herein as collision zone 345), which may indicate a potential area of collision between the two wellbores.

Visualization 300 may be updated as drilling progresses, in particular embodiments. For instance, the past trajectories 311 and 321 and future trajectories 312 and 322 may each be updated as drilling progresses further into the formation (i.e., as the current depths 310 and 320 change). Future trajectories 312 and 322 may also be updated as steering of wellbores 103 or 113 changes. In addition, the ranging error window 335 and survey error windows 340 may change as drilling progresses and/or as additional measurements are taken. This may include resetting the starting point (either zero or at the latest value of the ranging error window 335) of survey error windows 340 each time the current depths 310 and 320 change or each time an additional measurement is taken. Furthermore, as the survey error windows 340 change, the indicated collision zone 345 may change accordingly.

As described further below with respect to FIG. 4, a future depth at which to take the next ranging measurement 330 may be determined based on one or more factors (e.g., based on the current locations of the wellbores and the projected trajectories of the wellbores), and may be indicated in visualization as a next measurement depth 350.

Alerts may be generated and indicated in visualization 300, in particular embodiments. For example, an alert may be generated to an operator of the drilling system based on the determined next measurement depth 350, such as when the current drilling depth 310 is nearing the next measurement depth 350. In some embodiments, if an operator goes past the recommended next measurement depth 350, the drilling system may discontinue drilling until further measurements are taken. As another example, an alert may be generated based on future trajectories 312 and 322, such as when the trajectories suggest that the wellbores 103 and 113 may stray outside of a target separation distance range (which may also be indicated in visualization 300, similar to how collision zone 345 is indicated in FIG. 3).

Modifications, additions, or omissions may be made to FIG. 3 without departing from the scope of the present disclosure. For example, other indicators may be included in visualization beyond those depicted, such as depth indicators or formation property indicators. In addition, the shapes, shading, or colors of the items in visualization 300 may depend on the drilling application or desired outcomes. For example, collision zone 350 may be colored red when intersection between wellbores 103 and 113 is not desired (e.g., in SAGD applications), and colored green when intersection between wellbores 103 and 113 is desired (e.g., in relief well applications).

Figure 4:
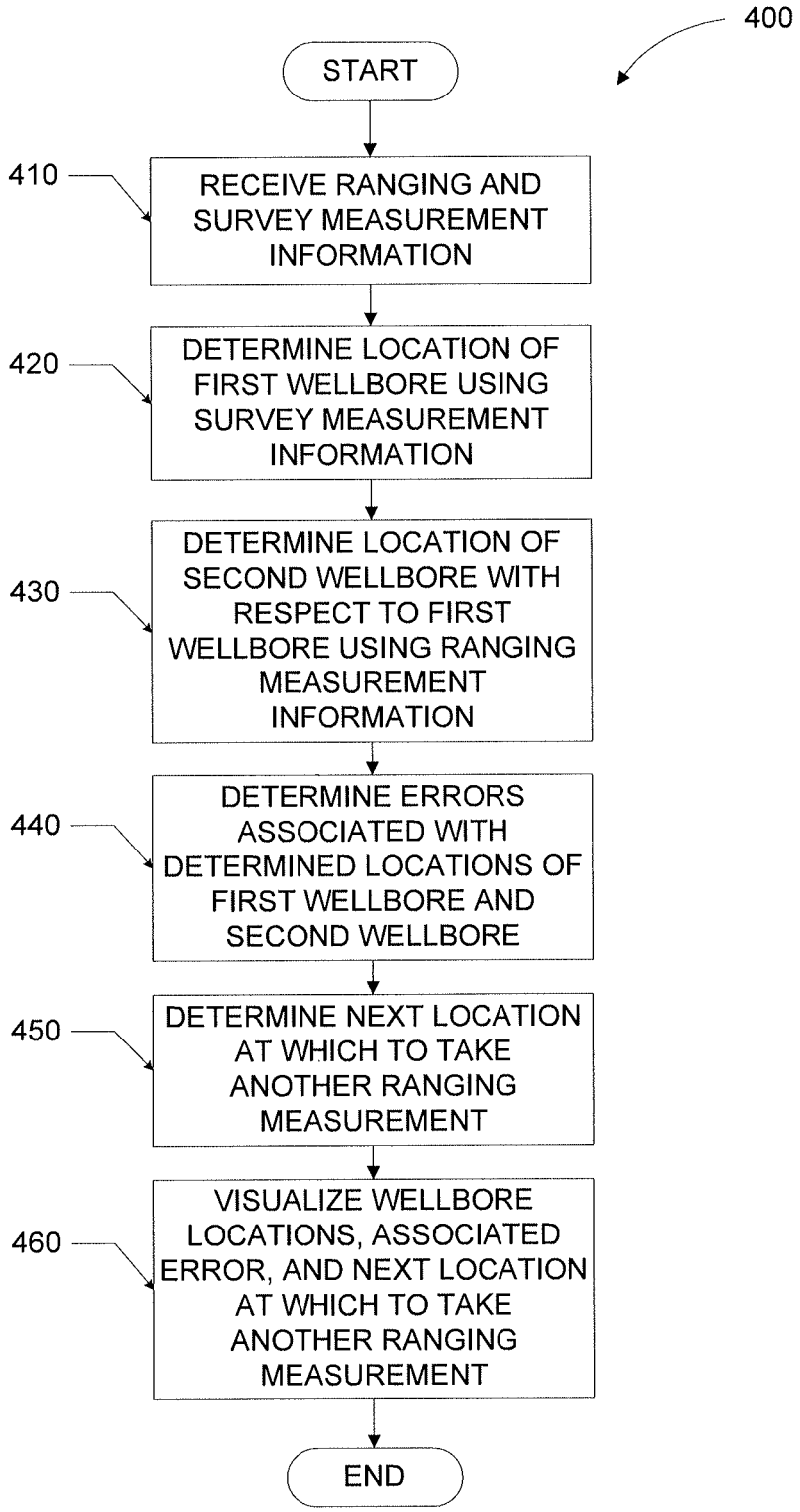
FIG. 4 illustrates an example method for determining a next location at which to take a ranging measurement, in accordance with embodiments of the present disclosure.

FIG. 4 illustrates an example method 400 for determining a next location at which to take a ranging measurement, in accordance with embodiments of the present disclosure. The method begins at step 410, where survey measurement information and ranging measurement information are received. The information may be received at a computing system such as computing system 200 of FIG. 2, and may be received from any suitable survey and ranging measurement systems, respectively. For instance, a survey measurement may be taken at the surface of a wellbore using accelerometers or gyroscopes to obtain information about formation 102 of FIG. 1, and may then conveyed to control unit 110 for processing. Ranging measurements may be taken from within a first wellbore in the formation, for example, using electromagnetic signals.

Using the received survey measurement information, the location of a first wellbore within a formation may be determined at step 420. Similarly, using the received ranging measurement information, the location of a second wellbore within a formation at step 430. The determined location of the second wellbore may be with respect to the first wellbore, in some embodiments. In certain embodiments, the received survey measurement information may also be used to determine the location of the second wellbore in the formation. The locations of the first wellbore and second wellbore may include past trajectories of the respective wellbores (e.g., what is visualized in FIG. 3 as past trajectories 311 and 321), or a path that the respective wellbore has taken through the formation up to a current depth. In certain embodiments, the locations of the first wellbore and second wellbore may include future trajectories of the respective wellbores (e.g., what is visualized in FIG. 3 as future trajectories 312 and 322). The future trajectories may be projected for incomplete wellbores (e.g., a relief well being drilled to intersect with a blowout wellbore) and may be based on a current depth, past trajectory, and/or current steering angle of a drilling system in some embodiments. The future trajectories may also be estimated for an existing wellbore (e.g., the blowout well in a relief well drilling application) and may be based on survey measurements in some embodiments.

At step 440, errors associated with the determined locations of the first wellbore and the second wellbore are determined. The errors may be associated with the past trajectory of the respective wellbore, the future trajectory of the respective wellbore, or both. For example, the error for the past trajectory of the second may include a ranging error calculation. The ranging error calculation may be based on the ranging measurement equipment used or properties of the formation, for example. An example ranging error may be seen with reference to ranging error window 335 in FIG. 3. As another example, an error for a past or future trajectory of a wellbore may include a survey error calculation. The survey error calculation may be based on the survey measurement equipment used or properties of the formation, for example. An example survey error calculation may be seen with reference to error window 340 for wellbore 113 in FIG. 3. In particular embodiments, the errors associated with the future trajectories of the wellbore may be based on a cumulative model, such as the Wolfe-Dewardt ellipse of uncertainty model.

At step 450, a next location at which to take another ranging measurement is determined. The determined next location may be based on the location of the first wellbore, the location of the second wellbore, the determined errors associated with the respective locations of the first wellbore and the second wellbore, or any combination thereof. In certain embodiments, the determined location at which to take another ranging measurement may be based on a determined potential intersection location between the first and second wellbores. The potential intersection location may be determined based on the location of the first wellbore, the location of the second wellbore, the determined errors associated with the respective locations of the first wellbore and the second wellbore, or any combination thereof. For example, the potential intersection location may be determined by calculating future trajectories of the two respective wellbores, and then further taking into account determined errors with respect to those future locations. Referring to FIG. 3, the future trajectories 312 and 322 may have error windows 340 associated therewith, and the potential intersection location may be determined by when the error windows overlap (shown in FIG. 3 as collision zone 345). The determined location at which to take another ranging measurement may be near the determined potential intersection location, and may be well before the determined potential intersection location to avoid a potential collision between the wellbores.

At step 460, the locations of the first and second wellbore are visualized. The visualization may be similar to visualization 300 of FIG. 3 with a particular perspective view, and may include any suitable visualization of an aspect of the first wellbore or second wellbore. For example, the visualization may include the past and future trajectories of the wellbores. As another examples, the visualization may include an axis indicator for reference to the perspective view of the visualization. In certain embodiments, the perspective view of the visualization may be modified. For example, the visualization may be zoomed or rotated by an operator of a drilling system. Furthermore, the visualization may be updated periodically. For example, the visualization may be updated as additional data is collected, such as additional ranging or survey measurement information as described below.

In particular embodiments, a second ranging measurement may be taken near the location determined at step 450 (not shown in FIG. 4). In some embodiments, this may also include taking additional survey measurements. With the new ranging and/or survey measurement information obtained from the new ranging and survey measurements, the respective locations of the first and second wellbore may be updated and the steps of method 400 may be repeated. For example, a new location at which to take another ranging measurement may be determined, and the relevant information in the visualization may be updated accordingly.

In particular embodiments, one or more alerts may be generated before or after any of steps 410-460. The alerts may be based on information gathered or determined by the drilling system. For example, the alerts may indicate the next location at which to take another ranging measurement determined at step 450, which may be based on the locations or associated errors for the respective wellbores. As the drilling system nears the determined location (e.g., the system is within 100 meters of the determined location), the alert may be generated to make an operator aware of the potential need to take another ranging location. As another example, the alerts may indicate close proximity of the drilling system to a determined potential intersection location. For example, an alert may be generated as a drilling system comes within 200 meters of a potential intersection location in order to alert an operator of a potential collision with another wellbore.

Modifications, additions, or omissions may be made to method 400 without departing from the scope of the present disclosure. For example, the order of the steps may be performed in a different manner than that described and some steps may be performed at the same time. Additionally, each individual step may include additional steps without departing from the scope of the present disclosure.

To provide illustrations of one or more embodiments of the present disclosure, the following examples are provided. In one embodiment, a wellbore ranging system comprises a processor, a memory, and a wellbore ranging module. The wellbore ranging module is operable to receive survey information in response to a survey measurement signal and determine, based on the survey information, a location of a first wellbore in a formation. The wellbore ranging module is also operable to receive first ranging information in response to a first ranging measurement signal sent from the first wellbore at a first depth in the first wellbore, and determine, based on the first ranging information, a location of a second wellbore in the formation and a second wellbore location error associated with the determined location of the second wellbore in the formation. The wellbore ranging module is further operable to determine, using the location of the first wellbore, the location of the second wellbore, and the second wellbore location error, a second depth in the first wellbore at which to send a second ranging measurement signal.

In one or more aspects of the disclosed system, the location of a second wellbore is further based on the received survey information, and the second wellbore location error is further based on the received survey information. In one or more aspects of the disclosed system, the determined location of the first wellbore comprises a past trajectory of the first wellbore in the formation, and the determined location of the second wellbore comprises a past trajectory of the second wellbore in the formation. In one or more aspects of the disclosed system, the determined location of the second wellbore further comprises a future trajectory of the second wellbore in the formation, and the wellbore ranging module is further operable to determine a future trajectory of the first wellbore based on the location of the first wellbore in the formation and a current steering angle of the first wellbore. In one or more aspects of the disclosed system, the wellbore ranging module is further operable to determine a first wellbore location error associated with the future trajectory of the first wellbore, and the second wellbore location error comprises a first portion and a second portion, the first portion being associated with the past trajectory of the second wellbore and the second portion being associated with the future trajectory of the second wellbore. In one or more aspects of the disclosed system, the wellbore ranging module is further operable to determine, using the first wellbore location error and the second wellbore location error, a location in the formation at which an intersection of the first wellbore and the second wellbore may occur. In one or more aspects of the disclosed system, the wellbore ranging module is further operable to determine the first wellbore location error and the second wellbore location error using the Wolfe-Dewardt ellipse of uncertainty model.

In one or more aspects of the disclosed system, the wellbore ranging module is further operable to receive second ranging information in response to the second ranging measurement signal sent from the first wellbore near the determined second depth in the first wellbore, update, based on the first ranging information, the location of the second wellbore, update, based on the first ranging information, the second wellbore location error, and determine, using the updated location of the first wellbore, the updated location of the second wellbore, and the updated second wellbore location error, a third depth in the first wellbore at which to send a third ranging measurement signal. In one or more aspects of the disclosed system, the wellbore ranging module is further operable to generate one or more alerts.

In one or more aspects of the disclosed system, the wellbore ranging module is further operable to generate a three-dimensional visualization comprising the determined locations of the first wellbore and the second wellbore. In one or more aspects of the disclosed system, the visualization further comprises the first wellbore location error and the second wellbore location error. In one or more aspects of the disclosed system, the visualization further comprises an axis indicator. In one or more aspects of the disclosed system, wherein the wellbore ranging module is further operable to modify a perspective view of the visualization. In one or more aspects of the disclosed system, the wellbore ranging module is further operable to update the visualization periodically.

In another embodiment, a method for determining locations at which to take a ranging measurements in a wellbore includes receiving survey information in response to a survey measurement signal and determining, based on the survey information, a location of a first wellbore in a formation. The method also includes receiving first ranging information in response to a first ranging measurement signal sent from the first wellbore at a first depth in the first wellbore and determining, based on the first ranging information, a location of a second wellbore in the formation and a second wellbore location error associated with the determined location of the second wellbore in the formation. The method further includes determining, using the location of the first wellbore, the location of the second wellbore, and the second wellbore location error, a second depth in the first wellbore at which to send a second ranging measurement signal.

In one or more aspects of the disclosed method, the location of a second wellbore is further based on the received survey information, and the second wellbore location error is further based on the received survey information. In one or more aspects of the disclosed method, the determined location of the first wellbore comprises a past trajectory of the first wellbore in the formation, and the determined location of the second wellbore comprises a past trajectory of the second wellbore in the formation. In one or more aspects of the disclosed method, the determined location of the second wellbore further comprises a future trajectory of the second wellbore in the formation, and the wellbore ranging module is further operable to determine a future trajectory of the first wellbore based on the location of the first wellbore in the formation and a current steering angle of the first wellbore. In one or more aspects of the disclosed method, the wellbore ranging module is further operable to determine a first wellbore location error associated with the future trajectory of the first wellbore, and the second wellbore location error comprises a first portion and a second portion, the first portion being associated with the past trajectory of the second wellbore and the second portion being associated with the future trajectory of the second wellbore. In one or more aspects of the disclosed method, the wellbore ranging module is further operable to determine, using the first wellbore location error and the second wellbore location error, a location in the formation at which an intersection of the first wellbore and the second wellbore may occur. In one or more aspects of the disclosed method, the wellbore ranging module is further operable to determine the first wellbore location error and the second wellbore location error using the Wolfe-Dewardt ellipse of uncertainty model.

In one or more aspects of the disclosed method, the wellbore ranging module is further operable to receive second ranging information in response to the second ranging measurement signal sent from the first wellbore near the determined second depth in the first wellbore, update, based on the first ranging information, the location of the second wellbore, update, based on the first ranging information, the second wellbore location error, and determine, using the updated location of the first wellbore, the updated location of the second wellbore, and the updated second wellbore location error, a third depth in the first wellbore at which to send a third ranging measurement signal. In one or more aspects of the disclosed method, the method further comprises generating one or more alerts.

In one or more aspects of the disclosed method, the method further comprises generating a three-dimensional visualization comprising the determined locations of the first wellbore and the second wellbore. In one or more aspects of the disclosed method, the visualization further comprises the first wellbore location error and the second wellbore location error. In one or more aspects of the disclosed method, the visualization further comprises an axis indicator. In one or more aspects of the disclosed method, the method further comprises modifying a perspective view of the visualization. In one or more aspects of the disclosed method, the method further comprises updating the visualization periodically.

In another embodiment, a computer-readable medium comprising instructions that, when executed by a processor, cause the processor to receive survey information in response to a survey measurement signal, and determine, based on the survey information, a location of a first wellbore in a formation. The instructions may also cause the processor, when executed, to receive first ranging information in response to a first ranging measurement signal sent from the first wellbore at a first depth in the first wellbore, and determine, based on the first ranging information, a location of a second wellbore in the formation and a second wellbore location error associated with the determined location of the second wellbore in the formation. The instructions may further cause the processor, when executed, to determine, using the location of the first wellbore, the location of the second wellbore, and the second wellbore location error, a second depth in the first wellbore at which to send a second ranging measurement signal.

In one or more aspects of the disclosed computer-readable medium, the location of a second wellbore is further based on the received survey information, and the second wellbore location error is further based on the received survey information. In one or more aspects of the disclosed computer-readable medium, the determined location of the first wellbore comprises a past trajectory of the first wellbore in the formation, and the determined location of the second wellbore comprises a past trajectory of the second wellbore in the formation. In one or more aspects of the disclosed computer-readable medium, the determined location of the second wellbore further comprises a future trajectory of the second wellbore in the formation, and the medium further comprises instructions that, when executed by a processor, cause the processor to determine a future trajectory of the first wellbore based on the location of the first wellbore in the formation and a current steering angle of the first wellbore. In one or more aspects of the disclosed computer-readable medium, the medium further comprises instructions that, when executed by a processor, cause the processor to determine a first wellbore location error associated with the future trajectory of the first wellbore, and the second wellbore location error comprises a first portion and a second portion, the first portion being associated with the past trajectory of the second wellbore and the second portion being associated with the future trajectory of the second wellbore. In one or more aspects of the disclosed computer-readable medium, the medium further comprises instructions that, when executed by a processor, cause the processor to determine, using the first wellbore location error and the second wellbore location error, a location in the formation at which an intersection of the first wellbore and the second wellbore may occur. In one or more aspects of the disclosed computer-readable medium, the medium further comprises instructions that, when executed by a processor, cause the processor to determine the first wellbore location error and the second wellbore location error using the Wolfe-Dewardt ellipse of uncertainty model.

In one or more aspects of the disclosed computer-readable medium, receive second ranging information in response to the second ranging measurement signal sent from the first wellbore near the determined second depth in the first wellbore, update, based on the first ranging information, the location of the second wellbore, update, based on the first ranging information, the second wellbore location error, and determine, using the updated location of the first wellbore, the updated location of the second wellbore, and the updated second wellbore location error, a third depth in the first wellbore at which to send a third ranging measurement signal. In one or more aspects of the disclosed computer-readable medium, the medium further comprises instructions that, when executed by a processor, cause the processor to generate alerts.

In one or more aspects of the disclosed computer-readable medium, the medium further comprises instructions that, when executed by a processor, cause the processor to generate a three-dimensional visualization comprising the determined locations of the first wellbore and the second wellbore. In one or more aspects of the disclosed computer-readable medium, the visualization further comprises the first wellbore location error and the second wellbore location error. In one or more aspects of the disclosed computer-readable medium, the visualization further comprises an axis indicator. In one or more aspects of the disclosed computer-readable medium, the medium further comprises instructions that, when executed by a processor, cause the processor to modify a perspective view of the visualization. In one or more aspects of the disclosed computer-readable medium, the medium further comprises instructions that, when executed by a processor, cause the processor to update the visualization periodically.

Illustrative embodiments of the present disclosure have been described herein. In the interest of clarity, not all features of an actual implementation may have been described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

It will be understood that the terms "couple" or "couples" as used herein are intended to mean either an indirect or a direct connection. Thus, if a first device couples to a second device, that connection may be through a direct connection, or through an indirect electrical or mechanical connection via other devices and connections. It will also be understood that the terms "drilling equipment" and "drilling system" are not intended to limit the use of the equipment and processes described with those terms to drilling an oil well. The terms will also be understood to encompass drilling natural gas wells or hydrocarbon wells in general. Further, such wells can be used for production, monitoring, or injection in relation to the recovery of hydrocarbons or other materials from the subsurface. This could also include geothermal wells intended to provide a source of heat energy instead of hydrocarbons.

To facilitate a better understanding of the present disclosure, examples of certain embodiments have been given. In no way should the examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the wellbore below), or otherwise nonlinear wellbores in any type of subterranean formation. Certain embodiments may be applicable, for example, to logging data acquired with wireline, slickline, and logging while drilling/measurement while drilling (LWD/MWD). Certain embodiments may be applicable to subsea and/or deep sea wellbores. Embodiments described above with respect to one implementation are not intended to be limiting.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A wellbore ranging system, comprising:

a processor;

a memory; and a wellbore ranging module operable to:

receive survey information in response to a survey measurement signal;

determine, based on the survey information, a location of a first wellbore in a formation;

receive first ranging information in response to a first ranging measurement signal sent from the first wellbore at a first depth in the first wellbore;

determine, based on the first ranging information, a location of a second wellbore in the formation;

determine, based on the first ranging information, a second wellbore location error associated with the determined location of the second wellbore in the formation;

determine, using the location of the first wellbore, the location of the second wellbore, and the second wellbore location error, a second depth in the first wellbore at which to send a second ranging measurement signal;

determine a future trajectory of the first wellbore based on the location of the first wellbore in the formation and a current steering angle of the first wellbore; and wherein:

the determined location of the first wellbore comprises a past trajectory of the first wellbore in the formation;

the determined location of the second wellbore comprises a past trajectory of the second wellbore in the formation; and the determined location of the second wellbore further comprises a future trajectory of the second wellbore in the formation.

2. The system of claim 1, wherein the location of a second wellbore is further based on the received survey information, and the second wellbore location error is further based on the received survey information.

3. The system of claim 1, wherein:

the wellbore ranging module is further operable to determine a first wellbore location error associated with the future trajectory of the first wellbore; and the second wellbore location error comprises a first portion and a second portion, the first portion being associated with the past trajectory of the second wellbore and the second portion being associated with the future trajectory of the second wellbore.

4. The system of claim 3, wherein the wellbore ranging module is further operable to determine, using the first wellbore location error and the second wellbore location error, a location in the formation at which an intersection of the first wellbore and the second wellbore may occur.

5. The system of claim 3, wherein the wellbore ranging module is further operable to determine the first wellbore location error and the second wellbore location error using the Wolfe-Dewardt ellipse of uncertainty model.

6. The system of claim 1, wherein the wellbore ranging module is further operable to receive second ranging information in response to the second ranging measurement signal sent from the first wellbore near the determined second depth in the first wellbore;

update, based on the first ranging information, the location of the second wellbore;

update, based on the first ranging information, the second wellbore location error; and determine, using the updated location of the first wellbore, the updated location of the second wellbore, and the updated second wellbore location error, a third depth in the first wellbore at which to send a third ranging measurement signal.

7. The system of claim 1, wherein the wellbore ranging module is further operable to generate one or more alerts.

8. The system of claim 1, wherein the wellbore ranging module is further operable to generate a three-dimensional visualization comprising the determined locations of the first wellbore and the second wellbore.

9. The system of claim 8, wherein the visualization further comprises the first wellbore location error and the second wellbore location error.

10. The system of claim 8, wherein the visualization further comprises an axis indicator.

11. The system of claim 8, wherein the wellbore ranging module is further operable to modify a perspective view of the visualization.

12. The system of claim 8, wherein the wellbore ranging module is further operable to update the visualization periodically.

13. A method for determining locations at which to take a ranging measurements in a wellbore, comprising:

receiving survey information in response to a survey measurement signal;

determining, based on the survey information, a location of a first wellbore in a formation;

receiving first ranging information in response to a first ranging measurement signal sent from the first wellbore at a first depth in the first wellbore;

determining, based on the first ranging information, a location of a second wellbore in the formation;

determining, based on the first ranging information, a second wellbore location error associated with the determined location of the second wellbore in the formation;

determining, using the location of the first wellbore, the location of the second wellbore, and the second wellbore location error, a second depth in the first wellbore at which to send a second ranging measurement signal;

determining a future trajectory of the first wellbore based on the location of the first wellbore in the formation and a current steering angle of the first wellbore; and wherein:

the determined location of the first wellbore comprises a past trajectory of the first wellbore in the formation;

the determined location of the second wellbore comprises a past trajectory of the second wellbore in the formation; and the determined location of the second wellbore further comprises a future trajectory of the second wellbore in the formation.

14. The method of claim 13, wherein the location of a second wellbore is further based on the received survey information, and the second wellbore location error is further based on the received survey information.

15. The method of claim 13, wherein:

the method further comprises determining a first wellbore location error associated with the future trajectory of the first wellbore; and the second wellbore location error comprises a first portion and a second portion, the first portion being associated with the past trajectory of the second wellbore and the second portion being associated with the future trajectory of the second wellbore.

16. The method of claim 15, wherein the method further comprises determining, using the first wellbore location error and the second wellbore location error, a location in the formation at which an intersection of the first wellbore and the second wellbore may occur.

17. The method of claim 15, wherein the method further comprises determining the first wellbore location error and the second wellbore location error using the Wolfe-Dewardt ellipse of uncertainty model.

18. The method of claim 13, wherein the method further comprises:

receiving second ranging information in response to the second ranging measurement signal sent from the first wellbore near the determined second depth in the first wellbore;

updating, based on the first ranging information, the location of the second wellbore;

updating, based on the first ranging information, the second wellbore location error; and determining, using the updated location of the first wellbore, the updated location of the second wellbore, and the updated second wellbore location error, a third depth in the first wellbore at which to send a third ranging measurement signal.

19. The method of claim 13, further comprising generating one or more alerts.

20. The method of claim 13, further comprising generating a three-dimensional visualization comprising the determined locations of the first wellbore and the second wellbore.

21. The method of claim 20, wherein the visualization further comprises the first wellbore location error and the second wellbore location error.

22. The method of claim 20, wherein the visualization further comprises an axis indicator.

23. The method of claim 20, further comprising modifying a perspective view of the visualization.

24. The method of claim 20, further comprising updating the visualization periodically.

25. A computer-readable medium comprising instructions that, when executed by a processor, cause the processor to:

receive survey information in response to a survey measurement signal;

determine, based on the survey information, a location of a first wellbore in a formation;

receive first ranging information in response to a first ranging measurement signal sent from the first wellbore at a first depth in the first wellbore;

determine, based on the first ranging information, a location of a second wellbore in the formation;

determine, based on the first ranging information, a second wellbore location error associated with the determined location of the second wellbore in the formation;

determine, using the location of the first wellbore, the location of the second wellbore, and the second wellbore location error, a second depth in the first wellbore at which to send a second ranging measurement signal;

determine a future trajectory of the first wellbore based on the location of the first wellbore in the formation and a current steering angle of the first wellbore; and wherein:

the determined location of the first wellbore comprises a past trajectory of the first wellbore in the formation;

the determined location of the second wellbore comprises a past trajectory of the second wellbore in the formation; and the determined location of the second wellbore further comprises a future trajectory of the second wellbore in the formation.

26. The computer-readable medium of claim 25, wherein the location of a second wellbore is further based on the received survey information, and the second wellbore location error is further based on the received survey information.

27. The computer-readable medium of claim 25, wherein:

the medium further comprises instructions that, when executed by a processor, cause the processor to determine a first wellbore location error associated with the future trajectory of the first wellbore; and the second wellbore location error comprises a first portion and a second portion, the first portion being associated with the past trajectory of the second wellbore and the second portion being associated with the future trajectory of the second wellbore.

28. The computer-readable medium of claim 27, wherein the medium further comprises instructions that, when executed by a processor, cause the processor to determine, using the first wellbore location error and the second wellbore location error, a location in the formation at which an intersection of the first wellbore and the second wellbore may occur.

29. The computer-readable medium of claim 27, further comprising instructions that, when executed by a processor, cause the processor to determine the first wellbore location error and the second wellbore location error using the Wolfe-Dewardt ellipse of uncertainty model.

30. The computer-readable medium of claim 25, further comprising instructions that are operable to cause a processor to:

receive second ranging information in response to the second ranging measurement signal sent from the first wellbore near the determined second depth in the first wellbore;

update, based on the first ranging information, the location of the second wellbore;

update, based on the first ranging information, the second wellbore location error; and determine, using the updated location of the first wellbore, the updated location of the second wellbore, and the updated second wellbore location error, a third depth in the first wellbore at which to send a third ranging measurement signal.

31. The computer-readable medium of claim 25, further comprising instructions that, when executed by a processor, cause the processor to generate alerts.

32. The computer-readable medium of claim 25, further comprising instructions that, when executed by a processor, cause the processor to generate a three-dimensional visualization comprising the determined locations of the first wellbore and the second wellbore.

33. The computer-readable medium of claim 32, wherein the visualization further comprises the first wellbore location error and the second wellbore location error.

34. The computer-readable medium of claim 32, wherein the visualization further comprises an axis indicator.

35. The computer-readable medium of claim 32, further comprising instructions that, when executed by a processor, cause the processor to modify a perspective view of the visualization.

36. The computer-readable medium of claim 32, further comprising instructions that, when executed by a processor, cause the processor to update the visualization periodically.

* * * * *